US009776443B1

(12) United States Patent
Myska

(10) Patent No.: US 9,776,443 B1
(45) Date of Patent: Oct. 3, 2017

(54) CRAFTWORK TOOLS AND KITS

(71) Applicant: My Sweet Petunia, Inc., Sherrard, IL (US)

(72) Inventor: Iliana Myska, Sherrard, IL (US)

(73) Assignee: My Sweet Petunia, Inc., Sherrard, IL (US)

( * ) Notice: Subject to any disclaimer, the term of this patent is extended or adjusted under 35 U.S.C. 154(b) by 0 days.

(21) Appl. No.: 15/411,964

(22) Filed: Jan. 21, 2017

Related U.S. Application Data

(63) Continuation-in-part of application No. 14/595,480, filed on Jan. 13, 2015, now Pat. No. 9,597,909.

(51) Int. Cl.

| | |
|---|---|
| ***B41K 3/02*** | (2006.01) |
| ***B41K 3/46*** | (2006.01) |
| ***B44B 5/00*** | (2006.01) |
| ***B41K 1/00*** | (2006.01) |

(52) U.S. Cl.
CPC ..... *B41K 3/02* (2013.01); *B41K 1/00* (2013.01); *B41K 3/46* (2013.01); *B44B 5/0052* (2013.01); *B44B 5/0085* (2013.01)

(58) Field of Classification Search
CPC .... B41K 1/00; B41K 3/46; B41K 3/02; B44B 5/0085; B44B 5/0052; B44B 5/00; B44B 5/026
See application file for complete search history.

(56) References Cited

U.S. PATENT DOCUMENTS

| | | | |
|---|---|---|---|
| 84,440 | A | 11/1868 | Reese |
| 1,086,861 | A | 2/1914 | Adams |
| 1,258,118 | A | 3/1918 | Jabs |
| 1,492,688 | A | 5/1924 | Hidalgo |
| 1,926,983 | A | 9/1933 | Lamb |
| 1,949,864 | A | 3/1934 | Helfrich |
| 1,958,628 | A | 5/1934 | Lamb et al. |
| 1,967,473 | A | 7/1934 | Helfrich |
| 1,972,020 | A | 8/1934 | Kline |

(Continued)

FOREIGN PATENT DOCUMENTS

| | | |
|---|---|---|
| JP | 58056886 | 4/1983 |
| JP | 63309443 | 12/1988 |

OTHER PUBLICATIONS

L Letterpress, www.youtube.com/watch?v=dwOFmG8xxM8.
VS Fiskars Stamp Press, www.youtube.com/watch?v=yvZMjsvxdZA.

*Primary Examiner* — Leslie J Evanisko
(74) *Attorney, Agent, or Firm* — Scott A. Hill; The Hill Law Firm, PLC

(57) ABSTRACT

A craftwork accessory may provide a portable and/or easy-to-use tool to help users' accurately and repeatedly apply stamp impressions and the like to items such as cardstock. The accessory may include a base portion, one or more elevated side portions and a hinged cover portion. The side portions may define a workspace for arranging the item. In operation, the item and stamp may be aligned in the workspace, during which a magnetic removable corner piece may be used to assist with alignment of the item, and the cover portion may be pressed onto the stamp to stick the stamp to the cover portion. The cover may then be opened, the stamp may be inked, and the cover portion may be closed and pressed onto the item to stamp the item. The accessory may also include fastening mechanisms, such as magnetic elements, to facilitate placement of the item and/or stamp.

18 Claims, 9 Drawing Sheets

(56) References Cited

U.S. PATENT DOCUMENTS

| | | | | |
|---|---|---|---|---|
| 1,995,403 | A | 3/1935 | Stoelting | |
| 2,025,691 | A | 12/1935 | Mintz | |
| 2,034,548 | A | 3/1936 | Zidar | |
| 2,130,188 | A | 9/1938 | Kauffman et al. | |
| 2,467,242 | A | 4/1949 | Swartz | |
| 3,812,781 | A | 5/1974 | Bissonet | |
| 3,972,284 | A | 8/1976 | Bell | |
| 4,625,640 | A | 12/1986 | Bunger | |
| 5,642,667 | A | 7/1997 | Sastre | |
| 6,453,573 | B1 | 9/2002 | Arnoid | |
| 7,104,192 | B1 * | 9/2006 | Corcoran | B31F 1/07 101/23 |
| 8,393,266 | B2 | 3/2013 | Rasmussen et al. | |
| 2002/0043161 | A1 | 4/2002 | Hutchison | |
| 2003/0110653 | A1 | 6/2003 | Schafer | |
| 2004/0165332 | A1 | 8/2004 | Beson | |
| 2005/0126407 | A1 | 6/2005 | Hixon | |
| 2007/0144366 | A1 | 6/2007 | Ogino | |
| 2007/0186747 | A1 | 8/2007 | Angevine | |
| 2007/0193458 | A1 * | 8/2007 | Cheng | B44B 5/0052 101/287 |
| 2008/0202367 | A1 * | 8/2008 | Biolcati Papa | B41K 1/50 101/333 |
| 2011/0030568 | A1 | 2/2011 | Tsai | |
| 2013/0025424 | A1 | 1/2013 | Block | |
| 2013/0206026 | A1 | 8/2013 | Konik | |
| 2016/0200126 | A1 | 7/2016 | Myska | |

* cited by examiner

200 Corner Piece
202 Lengthwise Bar
204 Inner Side
206 Outer Side
208 Free End
212 Widthwise bar
214 Inner Side
216 Outer Side
218 Free End
220 Magnet
222 Aperture
230 Inner Corner
232 Outer Corner
240 Item/Stampable Substrate
242 Stamp
244 Printed image

CRAFTWORK TOOLS AND KITS

RELATED APPLICATIONS

This application is a continuation-in-part of U.S. patent application Ser. No. 14/595,480, filed Jan. 13, 2015, now U.S. Pat. No. 9,597,909, and entitled "CRAFTWORK TOOLS AND KITS", the entire contents of which are incorporated herein by reference in their entirety.

BACKGROUND

Technical Field

The present application relates to tools for generating craft items, such as cards, and kits for generating craft items.

Background of the Invention

It is increasingly popular to make craft or handmade items such as cards, announcements and the like. Not only are the custom cards fun to make for crafters, the cards are appreciated more by the recipient. To help those that want to make a single birthday card or hundreds of wedding invitations, a wide variety of card blanks, toppers and embellishments are available. Stamps and stamp kits provide a great way for the average crafter to add professional quality graphics to their items. However, it can be difficult to properly align the stamp and/or get a clean impression on the item. If a clean impression is not made on the first attempt, the stamp must be realigned in exactly the same position or the item will be unusable.

To address these problems, a variety of tools have been developed to help apply stamps to items. However, these tools present their own problems. For example, printing press apparatuses may allow for repeated stamping in the same position, but they are costly and bulky. Often, these devices also make it difficult to see how the stamp will look on the item before making an impression. Smaller, portable items, such as that described in U.S. Pat. No. 6,453,573, generally allow a user to see how the stamp will look on the item before leaving an impression, but it is difficult to realign the stamp in the same position if a more than one impression is required.

Accordingly, a need has long existed for an improved craftwork accessory item.

BRIEF SUMMARY

In one embodiment, a craftwork accessory may provide a portable and/or easy-to-use tool to help users' accurately and repeatedly apply stamp impressions and the like to items such as cardstock. The accessory may include a base portion, one or more elevated side portions and cover portion. The side portions may define a workspace for arranging the item. The cover portion may be movably attached to the base portion or a side portion, for example, by one or more hinges. In operation, the item and stamp may be aligned in the workspace and the cover portion may be pressed onto the stamp to stick the stamp to the cover portion. The cover may then be opened, the stamp may be inked, and the cover portion may be closed and pressed onto the item to stamp the item. The accessory may include alignment indicia on the base portion, side portions and/or cover portion to facilitate placement of the item and/or stamp. The accessory may also include fastening mechanisms, such as magnetic elements, to facilitate placement of the item and/or stamp.

In still further embodiments, the present disclosure provides a corner piece that may be used with the accessory shown in FIGS. 1-8. In particular, the present disclosure provides an apparatus for craftwork comprising:

a substantially rectangular base comprising a base width, a base length and a base periphery defining a perimeter of the base;

a workspace configured to support a stampable substrate having a widthwise edge and a lengthwise edge;

a widthwise rigid raised side portion attached to the base and extending generally parallel to the base width, the widthwise rigid raised side portion adjacent to the periphery of the base and generally in the form of a rectangular ruler, the widthwise rigid raised side portion bordering the workspace and providing a structure against which the widthwise edge of the stampable substrate may be positioned;

a lengthwise rigid raised side portion attached to the base and extending generally parallel to the base length, the lengthwise rigid raised side portion adjacent to the periphery of the base and generally in the form of a rectangular ruler, the lengthwise rigid raised side portion bordering the workspace and providing a structure against which the lengthwise edge of the stampable substrate may be positioned, the lengthwise rigid raised side portion and the widthwise rigid raised side portion meeting at a corner having an angle of approximately 90 degrees;

a substantially rectangular cover portion comprising gridlines and connected to the base by at least one hinge, the substantially rectangular cover portion configured to pivot from an open position in which the substantially rectangular cover portion does not contact the widthwise and lengthwise rigid raised side portions to a closed position in which the substantially rectangular cover portion rests on the widthwise and lengthwise rigid raised side portions, the substantially rectangular cover portion comprising an interior surface facing the base when the substantially rectangular cover portion is in the closed position, the interior surface configured to accept an ink stamp, the substantially rectangular cover portion substantially covering the base when the substantially rectangular cover portion is in the closed position;

a removable corner piece configured to be placed on the workspace above the stampable substrate, the removable corner piece comprising a widthwise bar comprising an outer side configured to be placed against the widthwise rigid raised side portion and an inner side and a lengthwise bar comprising an outer side configured to be placed against the lengthwise rigid raised side portion and an inner side, the outer sides of lengthwise and widthwise bars meeting at an inner corner having an angle of approximately 90 degrees, an outer corner of the lengthwise and widthwise bars configured to be placed against the corner formed by the lengthwise rigid raised side portion and the widthwise rigid raised side portion;

wherein the substantially rectangular cover portion is translucent or clear and configured to allow a user to see a stampable substrate on the workspace when the substantially rectangular cover portion is in the closed position.

Optionally, the corner piece, when placed on the workspace, does not extend above the lengthwise and widthwise rigid raised side portions. Optionally, the corner piece has a thickness that is equal to or less than the thickness of the lengthwise and widthwise rigid raised side portions. Optionally, the corner piece is translucent or transparent/clear. Optionally, the inner sides of the lengthwise and the widthwise bars of the corner piece face a square-shaped recess/cut-out. Optionally, the lengthwise bar comprises a free edge sloping at a continuous angle from the outer side to the inner side of the lengthwise bar and the widthwise bar comprises a free edge sloping at a continuous angle from the outer side to the inner side of the widthwise bar, the free edge of the lengthwise bar substantially parallel to the free edge of the widthwise bar. Optionally, the hinge spaces the substantially rectangular cover portion above the base, when the substantially rectangular cover portion is in a closed position, by a distance substantially equal to a thickness of the lengthwise and the widthwise rigid raised side portions; and further wherein the substantially rectangular cover portion is configured to pivot at least about 180 degrees from the closed position to the open position. Optionally, the workspace is non-abrasive. Optionally, the workspace is in the form of a removable foam pad, the removable foam pad having a thickness less than a thickness of the lengthwise and widthwise rigid raised side portions. Optionally, the apparatus further includes a ferromagnetic material disposed below the workspace and the corner piece comprises at least one magnet configured to secure a stampable substrate located on the workspace to the ferromagnetic material. Optionally, the apparatus further includes an ink-stamp attached to the interior surface.

The present disclosure also provides a method of stamping a substrate comprising:

a) providing the apparatus;

b) providing a stampable substrate comprising a widthwise edge and a lengthwise edge;

c) placing the stampable substrate on the workspace against the corner formed by the lengthwise rigid raised side portion and the widthwise rigid raised side portion;

d) placing the removable corner piece on top of the stampable substrate and against the corner formed by the lengthwise rigid raised side portion and the widthwise rigid raised side portion;

e) placing an ink stamp on the interior surface; and f) moving the substantially rectangular cover portion from the open position to the closed position to mark the stampable substrate with the ink stamp.

Optionally, the corner piece further comprises a magnet.

Other systems, methods, features and advantages of the invention will be, or will become apparent to one with skill in the art upon examination of the following figures and detailed description. It is intended that all such additional systems, methods, features and technical advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION

The elements illustrated in the Figures interoperate as explained in more detail below. Before setting forth the detailed explanation, however, it is noted that all of the discussion below, regardless of the particular implementation being described, is exemplary in nature, rather than limiting.

Figure 1:
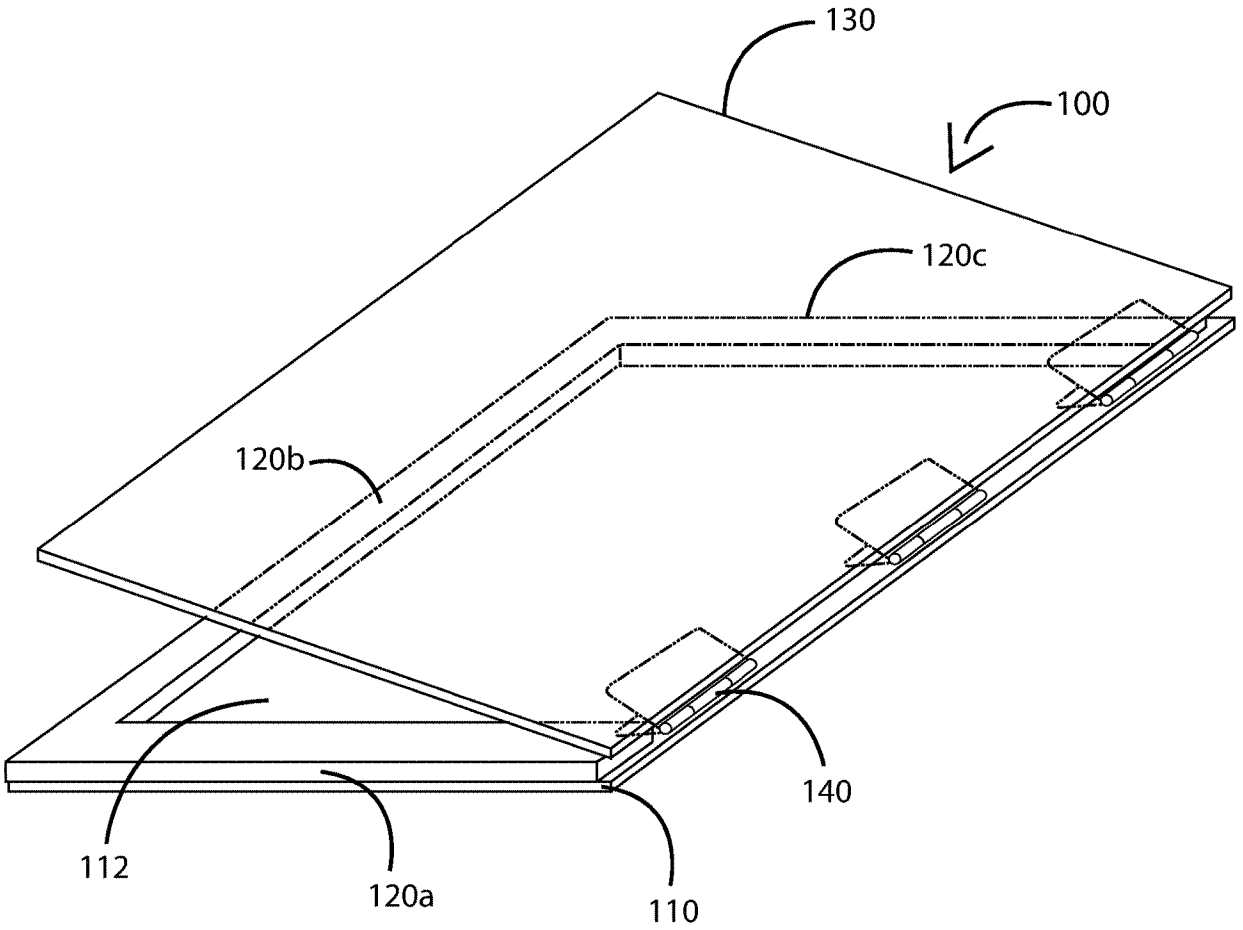
FIG. 1 shows a perspective view of an exemplary craftwork tool.

Referring to FIG. 1, an exemplary craftwork accessory 100 is shown. The accessory 100 may include a base portion 110, one or more elevated side portions 120 *a*, 120 *b*, and 120 *c*, and cover portion 130. The side portions 120 *a-c* may define a workspace 112 on the base portion 110 that may be used to place the item to be stamped or otherwise adorned. In some embodiments, such as the embodiment shown in FIG. 1, the accessory 100 may include three elevated side portions 120 *a-c*. In other embodiments, more or less elevated side portions may be provided. The cover portion 130 may be moveably attached to the base portion 110. Alternatively, or additionally, the cover portion 130 may be attached to one or more side portions 120 *a-c* and/or the base portion 110. In the illustrated embodiment, the cover portion 130 is attached to the base portion 110 by a hinge assembly 140. Other mechanisms for moveably attaching the cover portion 130 to other components of the accessory 100 may also be used. These may include, for example, brass hinges, piano hinges, non-hinge assemblies, and the like.

In one embodiment, the overall footprint of the accessory 100 is about 8" by about 10". In other embodiments, the width of the footprint of the accessory 100 may be between about 5" and about 15" and the length of the footprint of the accessory 100 may be between about 6" and about 16". These sizes typically allow the accessory 100 to be compatible with most common cardstock and the like while maintaining portability of the accessory 100. Other sizes may also be used. Alternatively, or additionally, the accessory 100 may be sold in various sizes, such as extra small, small, medium, large, and extra-large and/or in various colors. In some embodiments, different colors may be used for different components of the accessory.

The components of assembly 100 may be made of any suitable material. For example, rigid or semi-rigid materials such as acrylic, metal, tempered glass, cardboard and the like may be used. The components may be made of the same material, or different components may be made using different materials or combinations of materials. The assembly 100 as a whole may be made of a unified construction, subsets of components made of a unified construction, or each component may be separately constructed.

Figure 2:
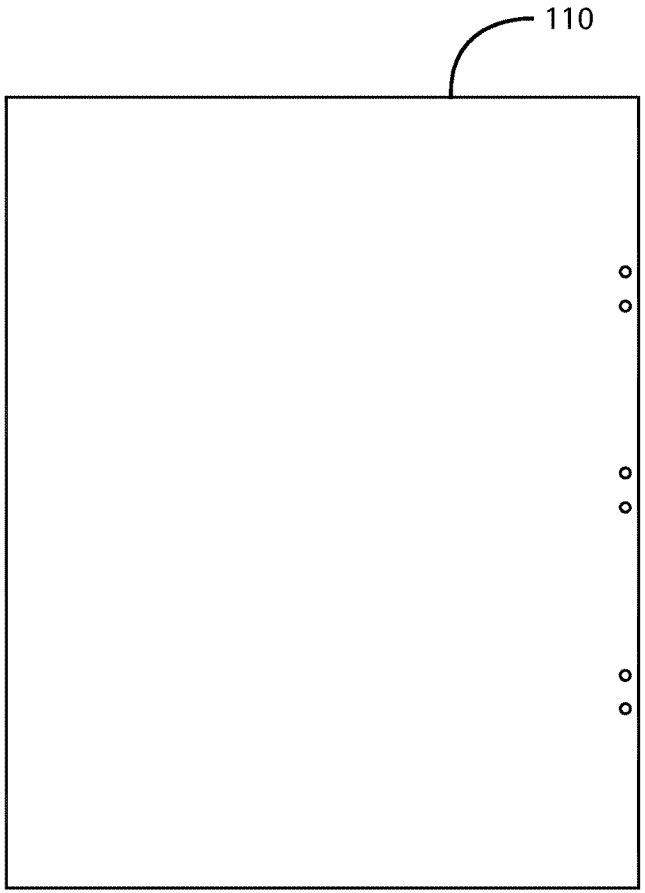
FIG. 2 shows a base portion of an exemplary craftwork tool.

An exemplary base portion 110 of an exemplary craftwork accessory 100 is shown in FIG. 2. The base portion 110 may be made of any suitable rigid or semi-rigid material, such as acrylic or the like. The base portion 110 may be translucent or opaque, clear or colored. The base portion 110 may define some or all of the footprint of the accessory item 100. For example, the base portion 110 may have a width of about 8", a length of about 10", and a thickness of about 3/32". Other sizes may also be used. The base portion 110 may include indicia 114 (FIG. 8*a*) to facilitate of an item on the workspace 112 of the base portion 110. The indicia 114 may include, for example, grid lines, ruler markings, and the like. The indicia 114 may be printed or laser etched onto either an upper or lower surface of the base portion 110 itself. Alternatively, or additionally, additional components including indicia 114 may be placed under or atop the base portions 110, such as a piece of grid paper, to facilitate alignment of the item on the workspace. Optionally, the bottom of the base portion 110 may be made of a material having a suitable coefficient of friction to impede movement or slippage of the accessory 100 during normal use (also referred to herein as a "non-slip" surface). Alternatively or additionally, such a material may be attached to or applied to the bottom or the top of the base portion 110.

Optionally, the accessory may include a fastening mechanism for securing the item to the work space. In one embodiment, the base portion 110 may include metal or other ferromagnetic material 118 (FIG. 5) for cooperating with a magnet 119 (FIG. 8*b*) placed on top of the item to secure the item on the workspace 112. Alternatively, or additionally, the ferromagnetic material 118 may be disposed above or below some or all of the workspace 112. Other mechanism may also be used to fasten the item to the workspace 112. For example, a top surface of the workspace 112 may have a coefficient of friction that impedes movement of an item placed thereon.

Figure 3B:
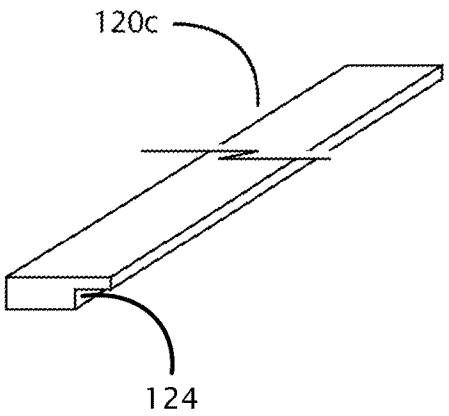
FIGS. 3*a-b* show side portions of an exemplary craftwork tool.
Figure 3A:
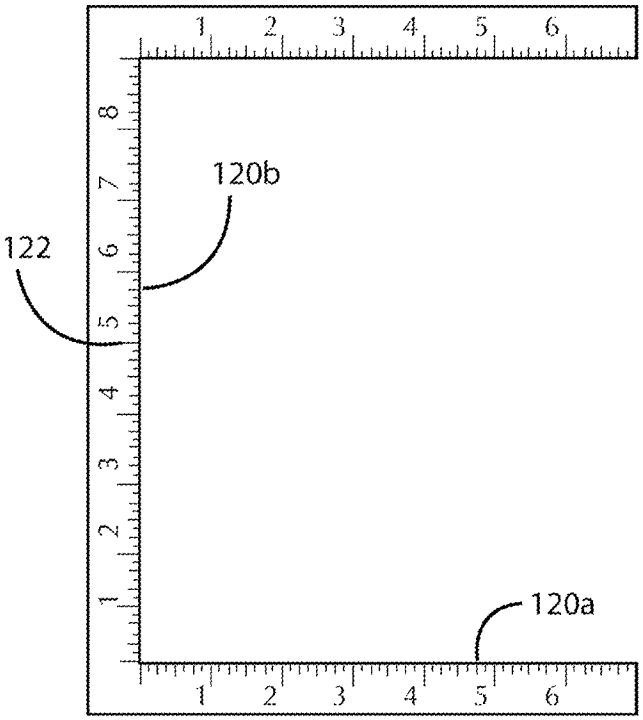

FIGS. 3*a-b* show exemplary side portions 120 *a-c* of an exemplary craftwork tool. In FIG. 3*a*, a top view of an exemplary side portions 120 *a-c* are shown. The side portions 120 *a-c* may be made up of a single piece or multiple pieces. The side portions 120 *a-c* may be disposed to the top of the base portion 110. Alternatively, or additionally, one or more of the side pieces may be attached to another part of the base portion 110, such as a side of the base portion 110. In one embodiment, the side portions may be attached to the top of the base portion 110 and have a thickness of at least about one-eighth inch so as to define a workspace 112 that is about one-eight inch deep. Other thicknesses may be used, such as one-quarter inch, one-third inch, one-half inch and the like. In some embodiments, one or more spacers 113 (FIG. 6) may be provided with the accessory to reduce the depth of the workspace 112 relative to the elevated side portions 120 *a-c*. Spacer 113 may be, for example, a foam pad. The spacer 113 may have a thickness proportional to the depth of the workspace 112, such as a thickness corresponding to one-half or one-quarter the depth of the workspace 112. Any other ratio may also be used.

Each side portion 120 *a-c* may be the same thickness and/or width, or each side portion 120 *a-c* may vary in thickness and/or width. For example, each side portion 120 *a-c* may be about three-quarters inches wide. The width of the side portions 120 *a-c* may vary with the overall footprint of the accessory 100. In some embodiments, the width of a side portion 120 *a-c* may be between about five percent and about twelve percent of the length or width of the overall footprint of the accessory 100.

The side portions 120 *a-c* may span some or all of the length of a side of the accessory 100, and each side piece 120 *a-c* may span a different length of its corresponding side. In some embodiments, the side portions 120 *a-c* may span at least one-fifth of the length of the side of the accessory 100. In other embodiments, the side portions 120*a-c* may span at least one fourth, one-third, or one-half of the length of a corresponding side of the accessory 100. Other lengths may also be used. The inner part of the side portions 120 *a-c* may abut the upper surface of base portion 110, or one or more of the side portions 120 *a-c* may include a recessed portion 124 that provides a gap between the upper surface of the base portion and a surface of side portion 120 *a-c*. An example of this is shown in FIG. 3*b*. The recessed portion 124 may allow a user of the accessory 100 additional alignment options, such as when creating a border on the item.

Optionally, the side portions 120 *a-c* are dimension to allow for the inclusion of indicia 122 for facilitating alignment of the item and/or stamp or other embellishment items. In some embodiments, indicia 122 may be disposed in one-eighth inch increments along one or all of the side portions 120 *a-c*. Other increments, such as numbers, gridlines and the like, also may be provided and different indicia may be placed on different side portions or within the same side portion. The indicia may be laser etched or printed to the side portion, or may be on a sticker, decal or the like affixed to one or more of the side portions 120 *a-c*. Combinations of techniques and/or indicia may also be used. In addition, any of the techniques for providing any indicia on any of the components of the accessory 100 may be used to provide indicia on any of the other components.

Figure 4:
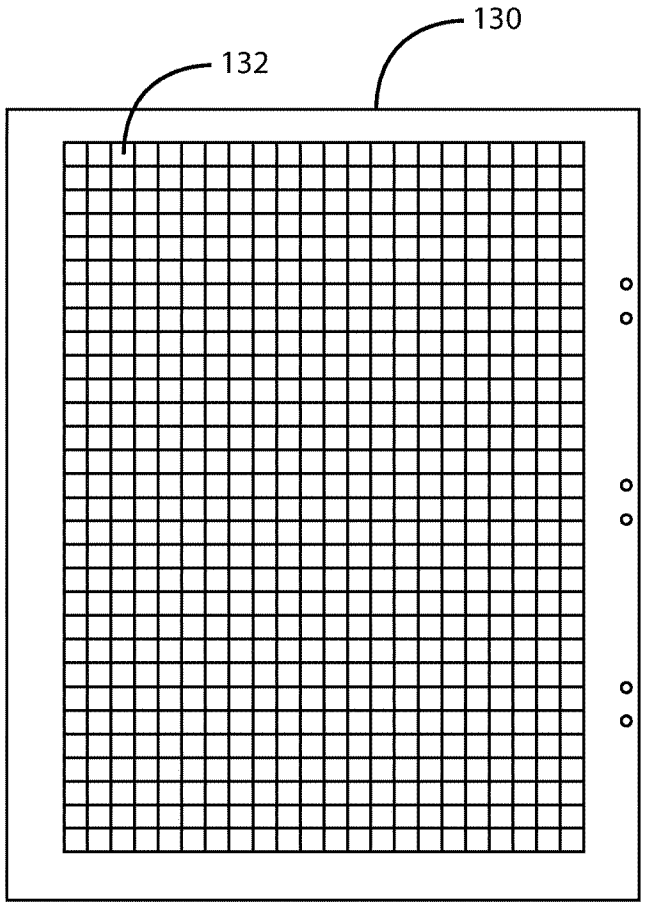
FIG. 4 shows a cover portion of an exemplary craftwork tool.

FIG. 4 shows a cover portion 130 of an exemplary craftwork tool. The cover portion 130 may be dimensioned similarly to the base portion 110, or may be dimensioned differently. In one embodiment, the cover may be about 8" wide by about 10" long. Other sizes, such as sizes appropriate for an accessory 100 having an overall footprint in the ranges discussed above, may also be used. The cover may be made of any suitable rigid or semi-rigid material, such as acrylic or the like. Preferably, the cover is translucent so as to allow a user of the accessory 100 to see the workspace even if the cover is closed. In other embodiments, the cover may be opaque.

Preferably, the cover includes indicia 132 for facilitating alignment of the item and/or stamp. For example, indicia 132 may include one-quarter inch gridlines, one-eighth inch, and the like. The indicia 132 may be, for example, printed or etched onto the cover 132. Other methods of placing indicia 132 on the cover 130 may also be used. In some embodiments, the cover portion 130 does not include any indicia 132.

Figure 5:
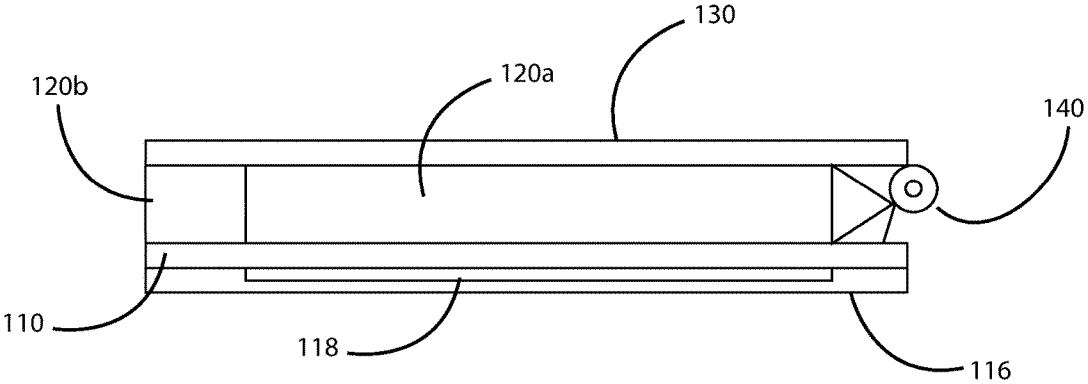
FIG. 5 shows a cross-sectional view of an exemplary craftwork tool.

FIG. 5 shows a cross-sectional view of an exemplary craftwork tool. As illustrated, the accessory 100 includes a base portion 110, side portions 120 *a-b*, and a cover portion 130 attached to the base portion 110 by a hinge assembly 140. In addition, a piece of ferromagnetic material 118 is provided under the base portion 110. The ferromagnetic material 118 may be secured in position by a non-slip surface 116, which may be attached to the base. Alternatively, both the ferromagnetic material 118 and the non-slip surface 116 may be attached to the base portion 110 independently.

Figure 6:
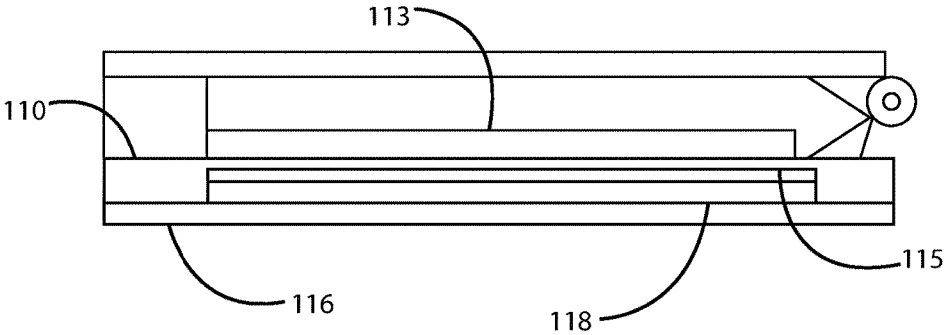
FIG. 6 shows a cross-sectional view of another exemplary craftwork tool.

FIG. 6 shows a cross sectional view of another exemplary craftwork tool. Similar to the embodiment shown in FIG. 5, the accessory 100 includes a base portion 110, side portions 120 *a-b*, and a cover portion 130 attached to the base portion 110 by a hinge assembly 140. In the embodiment shown in FIG. 6, a piece of ferromagnetic material 118 is provided in a recessed portion of the base portion 110. Additionally, an element 115 having indicia for alignment is also provided in the recessed portion of the base portion 110 so as to be visible by a user looking down on the workspace 112. Element 115 may be, for example, a piece of grid paper or the like. A removable spacer 113 is also provided in the workspace 112 to reduce the depth of the workspace 112.

Figure 7:
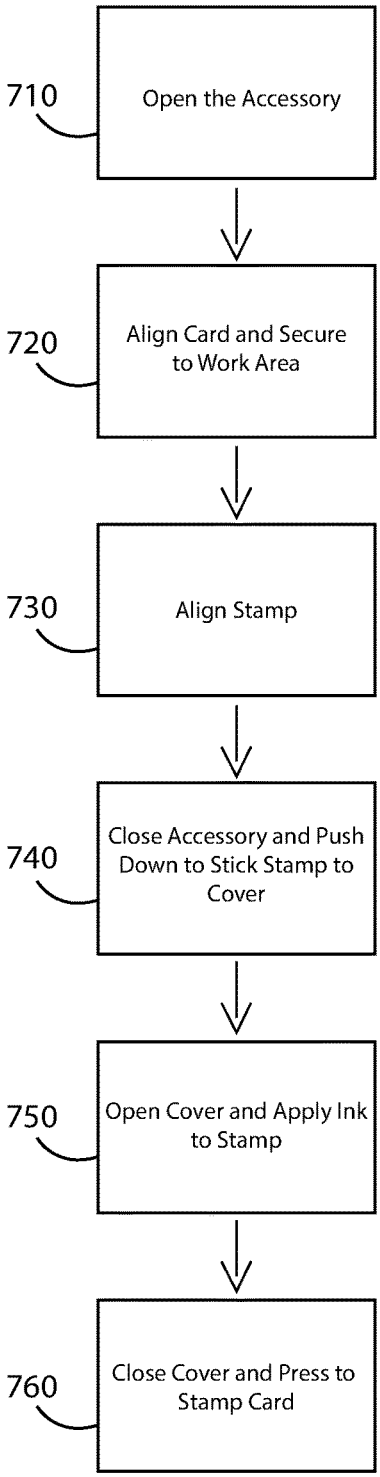
FIG. 7 shows a flow chart of an exemplary method of operation of an exemplary craftwork tool.
Figure 8A:
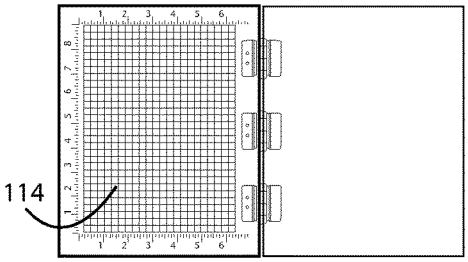
FIGS. 8*a-g* shows a series of depictions of an exemplary craftwork tool while performing the steps shown in FIG. 7.
Figure 8B:
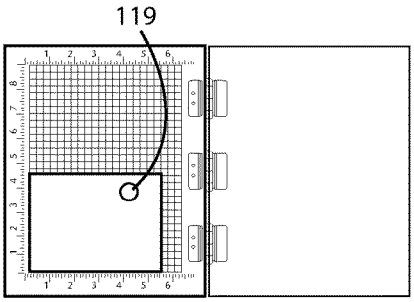
Figure 8C:
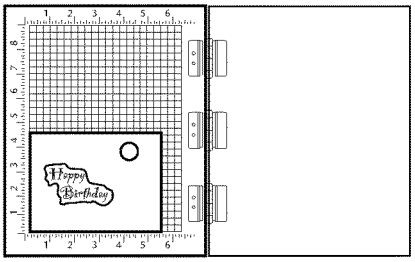
Figure 8D:
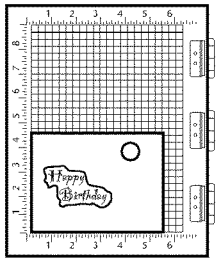
Figure 8E:
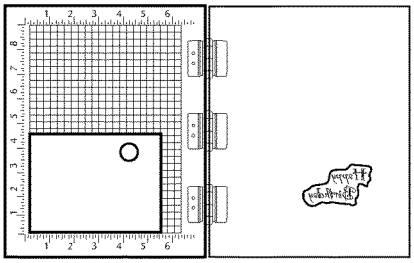
Figure 8F:
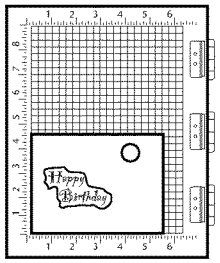
Figure 8G:
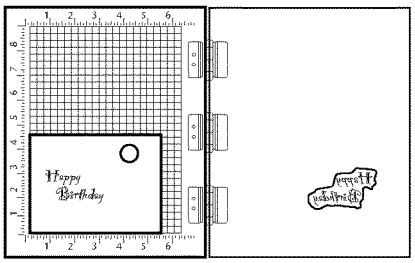

FIG. 7 shows a flow chart of an exemplary method of operation of an exemplary craftwork tool and FIGS. 8*a-g* shows a series of depictions of an exemplary craftwork tool while performing the steps shown in FIG. 7. Initially, a user opens the cover portion 130 of the accessory 100 at step 710 (as shown in FIG. 8*a*). The user then aligns the item in the workspace 112 and optionally secures the item in place at step 720 (as shown in FIG. 8*b*). In the illustrated embodiment, the item is secured in place by placing a magnet 119 on top of the item. Next, the user aligns the stamp on top of the item in a desired position at step 730 (as shown in FIG. 8*c*). In the illustrated embodiment, the user places a "Happy Birthday" stamp on the item. At step 740, the user closes the cover portion 130 and presses down to secure the stamp to the cover portion 130 (as shown in FIG. 8*d*). The user then opens the cover portion 130 and inks the stamp at step 750 (as shown in FIG. 8*e*). Once the stamp is inked, the user may close the cover portion 130 and press down to impress the image on the item at step 760 (as shown in FIG. 8*f*). As a result, the item is left with an impression of the stamped image as shown in FIG. 8 *g*.

As should be apparent to one in the art, if a clean impression is not made on the first attempt, the user may reapply ink and/or repress the stamp as necessary. Additionally, because both the item and the stamp are secured in their portions, the user may re-ink the stamp with various colors and apply the new impression to the enhance or otherwise alter the image on the item, or create multiple copies of the same item be aligning a new item in the same position and restamping. Additionally, the top of the cover may be used in a similar manner to stamp items that are not placed in workspace 112, such as oversized items. Referring to the embodiment shown in FIGS. 8*a-g*, a user can (1) place an item to the right of the accessory 100, (2) align a stamp on the item, (3) open the cover 130 and secure the stamp to the cover 130, (4) close the cover 130 and ink the stamp and (5) open the cover 130 to stamp the item. Other methods of operation may also be apparent to one of ordinary skill. Thus, the accessories 100 described herein provide solutions that offer a portable and easy-to-use tool for creating high-quality stamp impressions for a wide variety of uses.

Figure 9:
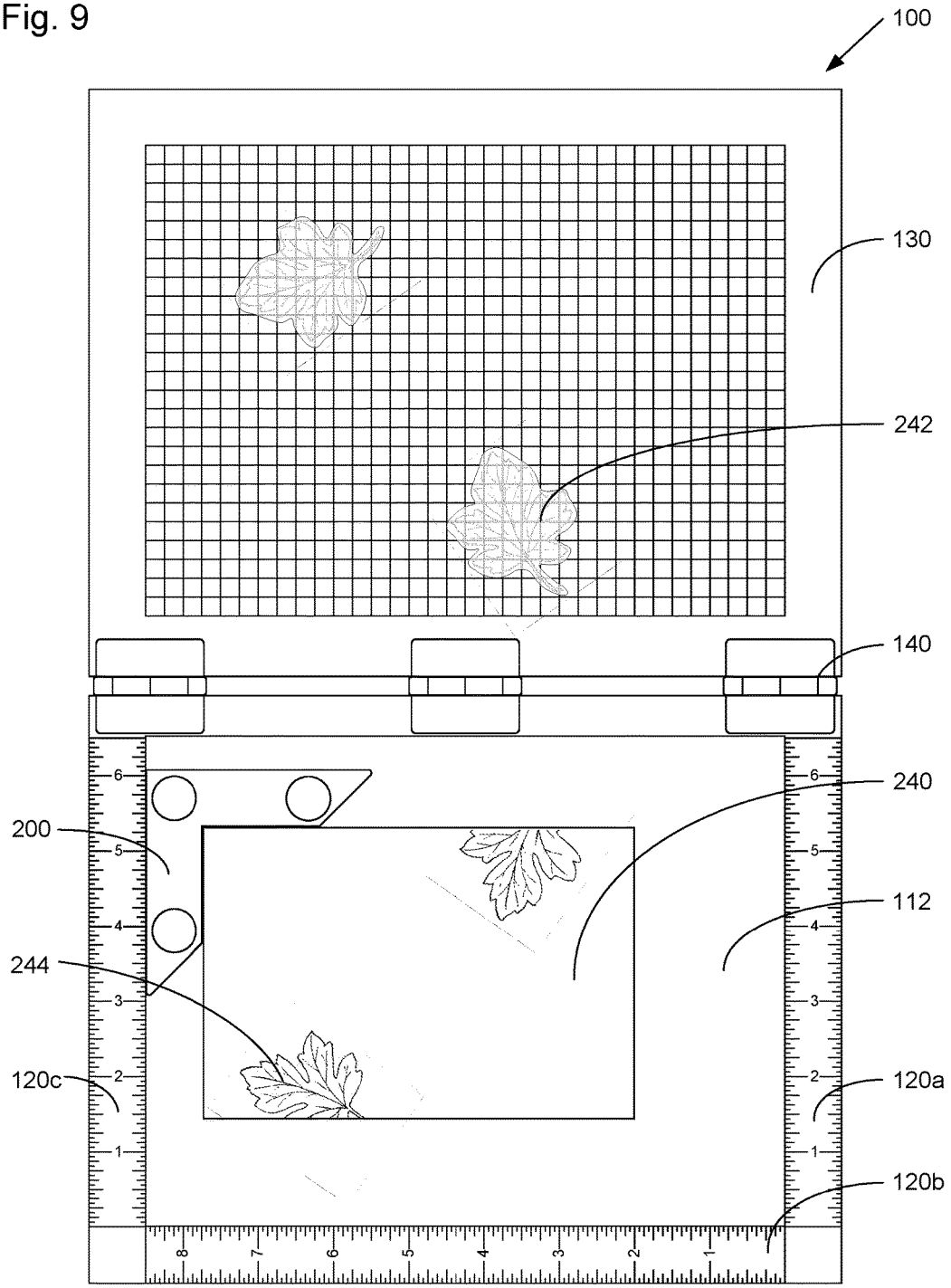
FIG. 9 shows a plan view of an exemplary craftwork tool with a removable corner piece.

The present disclosure further provides a corner piece 200 that may be used with the stamping accessory shown in FIGS. 1-8. FIG. 9 demonstrates why the corner piece may be necessary to produce a desired printed image 244 when stamping an item 240. If the corner piece were not used in FIG. 9, it would not be possible to stamp the desired leaf patterns if an item, such as cardstock, were positioned into a corner of the workspace. When stamps 242 are not within the four corners of an item to be stamped, any overlapping portion of a stamp may hit a ruler of the accessory 100 if the item is against a ruler. This would prevent portions of a stamp intended to transfer ink to an item from entering the workspace 112. An overlapping portion of a stamp would become a physical obstacle that prevents the cover 130 from fully closing. As shown, using a corner piece 200 will sufficiently move an item away from one or more of the rulers bordering the workspace, thereby allowing the cover to fully close so that a stamp 242 can transfer a desired print 244 to an item. Alternative embodiments of the corner piece are shown in FIGS. 14 through 18.

In particular, the present disclosure further provides an apparatus for craftwork that may include a substantially rectangular base comprising a base width, a base length and a base periphery defining a perimeter of the base, as previously described. (The base is the same as the previously described base portion 110).

The accessory may further include a workspace 112 configured to support a stampable substrate 240 having a widthwise edge and a lengthwise edge, as previously described. (The workspace is the same as the previously shown workspace 112).

The accessory may further include a widthwise rigid raised side portion 120 attached to the base and extending generally parallel to the base width, the widthwise rigid raised side portion adjacent to the periphery of the base and generally in the form of a rectangular ruler, the widthwise rigid raised side portion bordering the workspace and providing a structure against which the widthwise edge of the stampable substrate 240 may be positioned, as previously described.

The accessory may further include a lengthwise rigid raised side portion 120 attached to the base and extending generally parallel to the base length, the lengthwise rigid raised side portion adjacent to the periphery of the base and generally in the form of a rectangular ruler, the lengthwise rigid raised side portion bordering the workspace and providing a structure against which the lengthwise edge of the stampable substrate may be positioned, the lengthwise rigid raised side portion and the widthwise rigid raised side portion meeting at a corner having an angle of approximately 90 degrees, as previously described. (The widthwise and lengthwise rigid raised side portions are the same as the previously described side portions 120*a-c*).

The accessory may further include a substantially rectangular cover portion 130 comprising gridlines and connected to the base by at least one hinge 140, the substantially rectangular cover portion configured to pivot from an open position in which the substantially rectangular cover portion does not contact the widthwise and lengthwise rigid raised side portions to a closed position in which the substantially rectangular cover portion rests on the widthwise and lengthwise rigid raised side portions, the substantially rectangular cover portion comprising an interior surface facing the base when the substantially rectangular cover portion is in the closed position, the interior surface configured to accept an ink stamp 242, the substantially rectangular cover portion substantially covering the base when the substantially rectangular cover portion is in the closed position, as previously described. (The cover portion is the same as previously described cover portion 130). Optionally, the substantially rectangular cover portion may be translucent or clear and configured to allow a user to see a stampable substrate 240 on the workspace 112 when the substantially rectangular cover portion is in the closed position, as previously described.

The present disclosure further provides a removable corner piece 200 configured to be placed on the workspace 112, the removable corner piece comprising a widthwise bar 212 comprising an outer side 216 configured to be placed against the widthwise rigid raised side portion 120 and an inner side 214 and a lengthwise bar 202 comprising an outer side 206 configured to be placed anywhere on the workspace 112 or to be placed against the lengthwise rigid raised side portion and an inner side 204, the inner sides of lengthwise and widthwise bars meeting at an inner corner having an angle of approximately 90 degrees, and an outer corner of the lengthwise and widthwise bars configured to be placed against the lengthwise rigid raised side portion and/or the widthwise rigid raised side portion 120 *a-c*. Optionally, the removable corner piece 200 may be placed above the stampable substate to keep it from shifting on the workspace.

Optionally, the corner piece 200, when placed on the workspace 112, does not extend above the lengthwise and widthwise rigid raised side portions. Optionally, the corner piece has a thickness that is equal to or less than the thickness of the lengthwise and widthwise rigid raised side portions. Optionally, the corner piece is transparent or clear. Optionally, the inner sides of the lengthwise and the widthwise bars of the corner piece face a square-shaped recess/cut-out. Optionally, the lengthwise bar 202 comprises a free edge 208 sloping at a continuous angle from the outer side 206 to the inner side 204 of the lengthwise bar and the widthwise bar 212 comprises a free edge sloping at a continuous angle from the outer side to the inner side of the widthwise bar, the free edge of the lengthwise bar substantially parallel to the free edge of the widthwise bar. Optionally, the hinge 140 spaces the substantially rectangular cover portion above the base, when the substantially rectangular cover portion is in a closed position, by a distance substantially equal to a thickness of the lengthwise and the widthwise rigid raised side portions; and further wherein the substantially rectangular cover portion is configured to pivot at least about 180 degrees from the closed position to the open position. Optionally, the workspace is non-abrasive. Optionally, the workspace is in the form of a removable foam pad, the removable foam pad having a thickness less than a thickness of the lengthwise and widthwise rigid raised side portions. Optionally, the apparatus further includes a ferromagnetic material disposed below the workspace and the corner piece comprises at least one magnet configured to secure a stampable substrate located on the workspace to the ferromagnetic material. Optionally, the apparatus further includes an ink-stamp attached to the interior surface. Optionally, the apparatus is used in a method that includes: a) providing the apparatus; b) providing a stampable substrate comprising a widthwise edge and a lengthwise edge; c) placing the stampable substrate on the workspace against the corner formed by the lengthwise rigid raised side portion and the widthwise rigid raised side portion; d) placing the removable corner piece on top of the stampable substrate and against the corner formed by the lengthwise rigid raised side portion and the widthwise rigid raised side portion; e) placing an ink stamp on the interior surface; and f)

moving the substantially rectangular cover portion from the open position to the closed position to mark the stampable substrate with the ink stamp.

Sometimes it is desirable to position a stamp only partially over an item, or a stamp does not fit within the borders of an item, so a rigid raised side portion becomes an obstacle rather than a guide. In such cases, the corner piece 200 can be used to move an item away from an elevated side portion by establishing an inside corner 230 that is repositionable and relatively small. This corner piece is preferably a plastic "L" having embedded magnets 220 that cause it to be magnetically fixed to a magnetic workspace 112 of a craftwork accessory 100.

The lengthwise bar 202 and the widthwise bar 212 of the corner piece meet at a right angle to define the inside corner 230. Preferably, the two bars are made as a single piece part with a substantially uniform thickness. The preferred thickness of the corner piece is about three millimeters (3 mm). This thickness is ideal because a polymer stamp 242 used with a craftwork stamping tool is a little thicker than 3 mm, so a 3 mm thick corner piece provides a physical barrier that prevents a polymer stamp from being excessively compressed. One or more of the rigid raised side portions 120 of the craftwork accessory acts to prevent the lid from being pushed down too much along any particular side of the cover 130, which could cause a stamp to unevenly apply ink to an item or stampable substrate 240. The corner piece can be constructed from any desired rigid material, such as wood, plastic, metal or even different materials that are made or adhered together such that there is enough rigidity to define the inside corner. A transparent plastic material is most preferred, such as a clear acrylic, polycarbonate, polyethylene, PVC, butyrate or other similar plastic that is inexpensive. A plastic that melts at a lower temperature is preferred if an insert molding process is used to make the corner piece, noting that permanent magnets lose their magnetization when exposed to too much heat.

Figure 10:
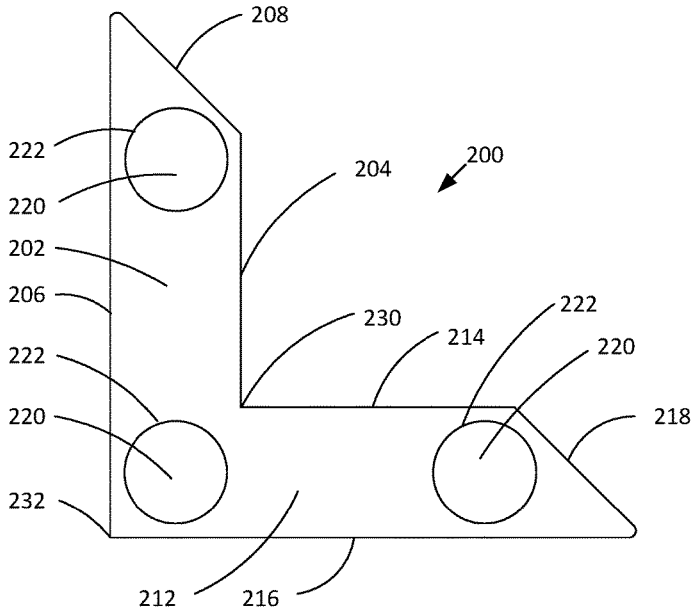
FIG. 10 shows a plan view of the removable corner piece shown in FIG. 9.
Figure 11:
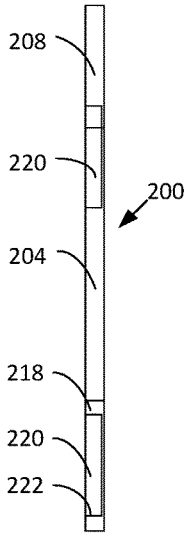
FIG. 11 shows a side elevation of the corner piece shown in FIG. 10, looking from the left to right.
Figure 12:
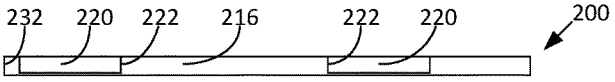
FIG. 12 shows a side elevation of the corner piece shown in FIG. 10, looking from the bottom to top.
Figure 13:
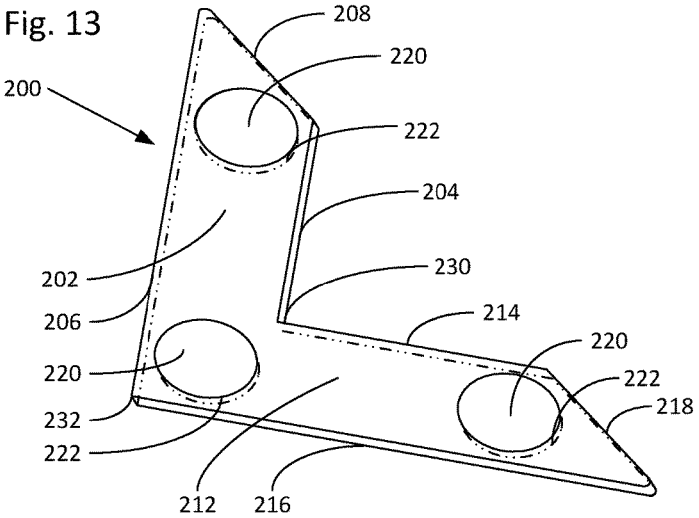
FIG. 13 shows a perspective view of the corner piece shown in FIG. 10.
Figure 14:
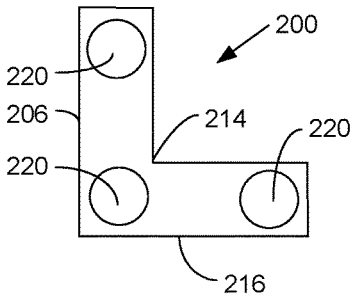
FIG. 14 shows a plan view of an alternative corner piece.
Figure 15:
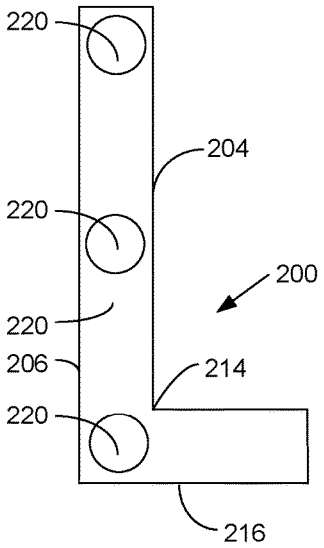
FIG. 15 shows a plan view of another alternative corner piece.
Figure 16:
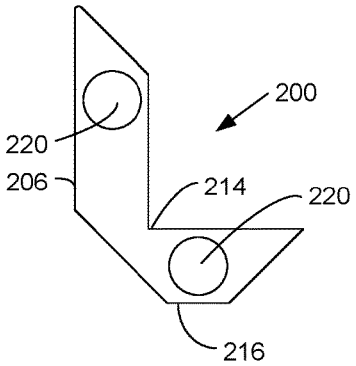
FIG. 16 shows a plan view of another alternative corner piece.
Figure 17:
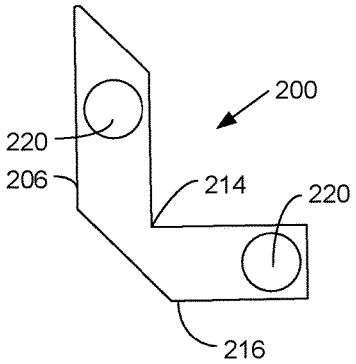
FIG. 17 shows a plan view of another alternative corner piece.
Figure 18:
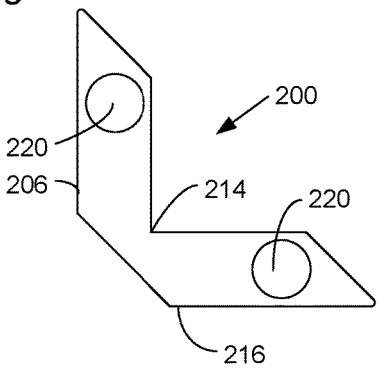
FIG. 18 shows a plan view of yet another alternative corner piece.

Each of the bars 202 and 212 preferably has a uniform width, with the width of the lengthwise bar and the widthwise bar preferably being the same. Each of the bars has an inside edge 204 and 214 and an outside edge 206 and 216. The inside edges of the bars provide the inside corner. The two bars may have different lengths, as shown in FIG. 15. Each of the bars has a length that terminates at a free end 208 and 218, which is the end of a bar farthest from the inside corner. Although the free ends could be any desired shape, such as rounded, the preferred free end has a straight edge. Preferred free ends may be perpendicular to their length, in which case the free ends of the arms will be perpendicular to each other, as shown in FIGS. 14 an 15. Alternatively, one or both of the free ends may be at an angle, such as thirty or forty-five degrees, to either that bar's inside edge or outside edge, as shown in FIGS. 10 and 16-18. It is sometimes useful to have straight free ends that are aligned along the same vector, as shown in FIGS. 10 and 18, so that the free ends can be easily positioned against a rigid raised side portion or other straight structure.

The outside edges of the bars may be extended until they meet at a right angle to form a ninety degree outside corner. Alternatively, the outside edges can terminate before they meet, such as by forming a forty-five degree outside corner, as shown in FIGS. 16 through 18, or a rounded outside corner.

Preferably, at least two magnets 220 are embedded in the corner piece. The magnets are preferably very strong permanent magnets made from rare-earth magnetic alloys, such as neodymium-iron-boron (NIB) magnets. A preferred NIB magnet is a disc, ring or block magnet having a magnetization direction that is axial, so the poles are on opposing flat ends of the magnet. The edges of a corner piece do not need to have any magnetic attractive force, but incidental magnetic attractive force is acceptable. Because the magnets are embedded, the width of a chosen magnet will determine the maximum width of an arm in which the magnet is embedded. A rectangular block magnet may allow an arm of the corner piece to have a smaller width, but disc magnets are readily available and less expensive. The thickness of a corner piece should not be greater than the thickness of a workspace, so it is preferable that the thickness of a magnet is less than the thickness of the corner piece.

A preferred position for the magnets is at least one embedded in each arm, midway between an outside edge and an inside edge, close to a free end. If a third magnet is used, the preferred location is between the inside corner and the outside corner, as shown in FIGS. 10 and 15. Alternatively, magnets could be all positioned along only one bar of the corner piece, such as shown in FIG. 15, which may make it easier to pick up the other bar. The magnets may be glued to apertures 222 in the lengthwise bar and the widthwise bar, or they may be insert molded into apertures 222 at the lowest heat practical to avoid demagnetizing the magnets, Optionally, the any of the various edges of the corner piece may be chamfered or otherwise cut such that the top is broader than the bottom so it is easier to grasp the corner piece when it is magnetically attached to the workspace. Optionally, the thickness of the corner piece may be the same or less than a polymer stamp. Optionally, a flat end of a magnet may be covered by a thin layer of plastic, or a flat end may be flush with a top or bottom surface of the corner piece. Optionally, the magnets may be press-fit and/or glued into apertures of the corner piece.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An apparatus for craftwork comprising:

a substantially rectangular base comprising a base width, a base length and a base periphery defining a perimeter of the base;

a workspace configured to support a stampable substrate having a widthwise edge and a lengthwise edge;

a widthwise rigid raised side portion attached to the base and extending generally parallel to the base width, the widthwise rigid raised side portion adjacent to the periphery of the base and generally in the form of a rectangular ruler, the widthwise rigid raised side portion bordering the workspace and providing a structure against which the widthwise edge of the stampable substrate may be positioned;

a lengthwise rigid raised side portion attached to the base and extending generally parallel to the base length, the lengthwise rigid raised side portion adjacent to the periphery of the base and generally in the form of a rectangular ruler, the lengthwise rigid raised side portion bordering the workspace and providing a structure against which the lengthwise edge of the stampable substrate may be positioned, the lengthwise rigid raised side portion and the widthwise rigid raised side portion meeting at a corner having an angle of approximately 90 degrees;

a substantially rectangular cover portion comprising gridlines and connected to the base by at least one hinge, the substantially rectangular cover portion configured to pivot from an open position in which the substantially rectangular cover portion does not contact the widthwise and lengthwise rigid raised side portions to a closed position in which the substantially rectangular cover portion rests on the widthwise and lengthwise rigid raised side portions, the substantially rectangular cover portion comprising an interior surface facing the base when the substantially rectangular cover portion is in the closed position, the interior surface configured to accept an ink stamp, the substantially rectangular cover portion substantially covering the base when the substantially rectangular cover portion is in the closed position;

a removable corner piece configured to be placed on the workspace the removable corner piece comprising a widthwise bar comprising an outer side configured to be placed against the widthwise rigid raised side portion and an inner side and a lengthwise bar comprising an outer side configured to be placed against the lengthwise rigid raised side portion and an inner side, the inner sides of the lengthwise bar and the widthwise bar meeting at an inner corner having an angle of approximately 90 degrees;

wherein the substantially rectangular cover portion is translucent or clear and configured to allow a user to see a stampable substrate on the workspace when the substantially rectangular cover portion is in the closed position.

2. The apparatus of claim 1 wherein the corner piece, when placed on the workspace, does not extend above the lengthwise and widthwise rigid raised side portions.

3. The apparatus of claim 1, wherein the corner piece has a thickness that is equal to or less than the thickness of the lengthwise and widthwise rigid raised side portions.

4. The apparatus of claim 1, wherein the corner piece is translucent or clear.

5. The apparatus of claim 1, wherein the inner sides of the lengthwise and the widthwise bars of the corner piece face a square-shaped recess.

6. The apparatus of claim 1 wherein the lengthwise bar comprises a free edge sloping at a continuous angle from the outer side to the inner side of the lengthwise bar and the widthwise bar comprises a free edge sloping at a continuous angle from the outer side to the inner side of the widthwise bar, the free edge of the lengthwise bar substantially parallel to the free edge of the widthwise bar.

7. The apparatus of claim 1 wherein the hinge spaces the substantially rectangular cover portion above the base, when the substantially rectangular cover portion is in a closed position, by a distance substantially equal to a thickness of the lengthwise and the widthwise rigid raised side portions; and further wherein the substantially rectangular cover portion is configured to pivot at least about 180 degrees from the closed position to the open position.

8. The apparatus of claim 1 wherein the workspace is non-abrasive.

9. The apparatus of claim 8 wherein the workspace is in the form of a removable foam pad, the removable foam pad having a thickness less than a thickness of the lengthwise and widthwise rigid raised side portions.

10. The apparatus of claim 1 further comprising a ferromagnetic material disposed below the workspace and the corner piece comprises at least one magnet attracted to the ferromagnetic material.

11. The apparatus of claim 1 further comprising an ink-stamp attached to the interior surface.

12. The apparatus of claim 1 wherein the widthwise bar is generally straight and the lengthwise bar is generally straight.

13. The apparatus of claim 1 wherein the widthwise bar and the lengthwise bar are rigid.

14. The apparatus of claim 1 wherein the outer sides of lengthwise and widthwise bars meet at an outer corner having an angle of approximately 90 degrees and further wherein the outer corner is configured to be placed against the corner formed by the lengthwise rigid raised side portion and the widthwise rigid raised side portion.

15. A method of stamping a substrate comprising:

a) providing the apparatus of claim 1;

b) providing a stampable substrate comprising a widthwise edge and a lengthwise edge;

c) placing the stampable substrate on the workspace against the corner formed by the lengthwise rigid raised side portion and the widthwise rigid raised side portion;

d) placing the removable corner piece on top of the stampable substrate and against the corner formed by the lengthwise rigid raised side portion and the widthwise rigid raised side portion;

e) placing an ink stamp on the interior surface; and f) moving the substantially rectangular cover portion from the open position to the closed position to mark the stampable substrate with the ink stamp.

16. The method of claim 15 wherein the corner piece further comprises a magnet.

17. A method of stamping a substrate comprising:

a) providing the apparatus of claim 1;

b) providing a stampable substrate comprising a widthwise edge and a lengthwise edge;

c) placing the widthwise edge of the stampable substrate against the widthwise bar and placing the lengthwise edge of the stampable substrate against the lengthwise bar;

d) placing an ink stamp on the interior surface; and e) moving the substantially rectangular cover portion from the open position to the closed position to mark the stampable substrate with the ink stamp.

18. An apparatus for craftwork comprising:

a base;

a workspace configured to support a stampable substrate having a widthwise edge and a lengthwise edge;

a ferromagnetic material disposed below the workspace;

a cover portion configured to pivot from an open position in which the cover portion does not face the base to a closed position in which the cover portion is located above and faces the base, the cover portion comprising an interior surface facing the base when the cover portion is in the closed position, the interior surface configured to accept an ink stamp;

a removable corner piece configured to be placed on the workspace above the ferromagnetic material, the removable corner piece comprising a magnet, a widthwise bar comprising an outer side and an inner side and a lengthwise bar comprising an outer side and an inner side, and the inner sides of the lengthwise bar and the widthwise bar meeting at an inner corner having an angle of approximately 90 degrees.

* * * * *